US007940242B2

(12) United States Patent
Lin

(10) Patent No.: US 7,940,242 B2
(45) Date of Patent: May 10, 2011

(54) DRIVING CIRCUIT FOR DRIVING LIQUID CRYSTAL DISPLAY DEVICE AND METHOD THEREOF

(75) Inventor: Wen-Tsung Lin, Tainan County (TW)

(73) Assignee: Chi Mei Optoelectronics Corp., Tainan County (TW)

( * ) Notice: Subject to any disclaimer, the term of this patent is extended or adjusted under 35 U.S.C. 154(b) by 1037 days.

(21) Appl. No.: 11/626,998

(22) Filed: Jan. 25, 2007

(65) Prior Publication Data

US 2007/0176881 A1 Aug. 2, 2007

(30) Foreign Application Priority Data

Jan. 27, 2006 (TW) ..... 95103259 A

(51) Int. Cl.
*G09G 3/36* (2006.01)

(52) U.S. Cl. ..... 345/99

(58) Field of Classification Search ..... 345/98, 345/99, 204
See application file for complete search history.

(56) References Cited

U.S. PATENT DOCUMENTS

| | | | | |
|---|---|---|---|---|
| 5,406,304 | A * | 4/1995 | Shirayama | 345/98 |
| 5,764,238 | A * | 6/1998 | Lum et al. | 345/660 |
| 6,476,590 | B2 | 11/2002 | Chou | |
| 6,628,253 | B1 * | 9/2003 | Hiroki | 345/87 |
| 6,940,496 | B1 * | 9/2005 | Kim | 345/204 |
| 7,084,840 | B2 * | 8/2006 | Moon | 345/87 |
| 7,221,346 | B2 | 5/2007 | Wang et al. | |
| 2004/0085503 | A1 * | 5/2004 | Kim et al. | 349/141 |
| 2004/0155849 | A1 * | 8/2004 | Bu et al. | 345/98 |
| 2004/0222959 | A1 * | 11/2004 | Lin et al. | 345/98 |
| 2004/0227715 | A1 | 11/2004 | Yamazaki | |
| 2004/0227717 | A1 * | 11/2004 | Yeh | 345/100 |
| 2006/0197730 | A1 * | 9/2006 | Ooga et al. | 345/98 |

FOREIGN PATENT DOCUMENTS

| | | | |
|---|---|---|---|
| JP | 2004348108 | A | 12/2004 |
| KR | 20040086190 | A | 10/2004 |
| TW | 554322 | B | 9/2003 |

* cited by examiner

*Primary Examiner* — Chanh Nguyen
*Assistant Examiner* — Jonathan Blancha

(57) ABSTRACT

In a driving circuit and its driving method for driving a liquid crystal display device without using a pre-processor, the driving circuit includes a first timing controller for receiving a first part of digital image data, a second timing controller for receiving a second part of the digital image data, and a plurality of data drivers, each of which is electrically connected to both the first timing controller and the second timing controller to receive the first part or the second part of the digital image data through the first timing controller or the second timing controller, respectively, for driving the liquid crystal display device.

14 Claims, 7 Drawing Sheets

DRIVING CIRCUIT FOR DRIVING LIQUID CRYSTAL DISPLAY DEVICE AND METHOD THEREOF

This application is based on and claims priority from Taiwan application No. 95103259 filed Jan. 27, 2006 which is incorporated by reference herein in its entirety.

TECHNICAL FIELD

The disclosure relates to a driving circuit and method thereof for driving a liquid crystal display device, and more particularly to a driving circuit and its driving method without a pre-processor for driving a liquid crystal display device.

BACKGROUND

In a liquid crystal display device, an electric field applied to each pixel of the liquid crystal panel is adjusted to change the orientation direction of liquid crystal molecules of each pixel. The liquid crystal molecules of each pixel will rotate the polarization direction of light when an electric field is applied across the pixel. Thus, the transmittance of the liquid crystal cell could be changed in order to display the polarized light of the successive frames on the liquid crystal panel of the liquid crystal display device. However, liquid crystal cells vary in transmittance relatively slowly. Therefore, the desired orientation direction of liquid crystal molecules of pixels could not be reached during a predetermined period when the electric field is applied to each pixel of the liquid crystal panel.

The pixel response speed in current liquid crystal display devices are slower than that in Cathode Ray Tubes (CRTs). Consequently, in displaying moving images in particular, blurs in which data of previous frames appears overlapped, so called image trails, tend to occur in liquid crystal display devices. This phenomenon is unique to liquid crystal display devices, but is not seen in CRTs. To reduce image trails and bring the moving image display performance close to that of CRTs, there has been developed a technology called an impulse drive system which imitates the waveforms of applied voltages in CRTs. In addition, in conventional hold-type displays, an overdrive method has been developed to improve the moving image display performance. The overdrive method is a technique of writing larger magnitude data signals than the actual data signals to the liquid crystal cells so that the liquid crystal cells reach their target transmittance within a frame period. In the case where the liquid crystal display device has a refresh rate of 60 Hz, for example, one frame period is about 16.6 ms. Therefore, the video input data rate of the over-drive circuit is limited to the refresh rate or frame rate of the liquid crystal display device, namely the fastest response speed of the liquid crystal display device is 16.6 ms even though the video input data rate of the overdrive circuit exceeds 60 Hz. However, since the liquid crystal cells having a response time of 16.6 ms could not satisfy characteristics of visual perception of humans, there exists the motion blur phenomenon in displaying moving pictures. The technical trend in currently available high-quality liquid crystal display devices is to improve the response time of the liquid crystal display devices.

In order to improve the response time of the liquid crystal display device, one method is to increase the frame rate of the liquid crystal display device. In the case where the liquid crystal display device has a faster frame rate of 120 Hz, for example, one frame is about 8.3 ms. Thus, the overdrive circuit could change the response time of the liquid crystal display device from 16.6 ms to 8.3 ms. This means that the moving image display performance could be improved. Accordingly, it is well established that the main factor for improving the moving image display performance is the use of a high frame rate of the liquid crystal display device and today's well-accepted frame rate is 120 Hz and above.

The number of data bus lines of the input interface of a liquid crystal display panel has to be doubled because the amount of the image data transmission for a liquid crystal display device running at the 120 Hz frame rate is double. Referring to FIG. 1, a general block diagram of a driving circuit in a conventional liquid crystal display device is illustrated. As shown in FIG. 1, in the conventional image data transmission technique, image data is divided into an odd part 110 and an even part 120, wherein one half of the data bus lines are utilized to transmit the odd part 110 of the image data and the other half of the data bus lines are utilized to transmit the even part 120 of the image data. The odd part 110 of the image data includes several odd sections 110A, 110B, 110C, and 110D of the image data. Each odd section contains a part of the image data which is delivered by at least one data bus line. Additionally, the even part 120 of the image data includes several even sections 120A, 120B, 120C, and 120D of the image data. Each even section also contains a part of the image data which is delivered by at least one data bus line. In this case, a single timing controller could not deal with such a large amount of image data that another timing controller should be added to assist processing of the image data. As shown in FIG. 1, there are a first timing controller 160 and a second timing controller 170.

In the above-mentioned case, the conventional technique delivers the odd part 110 of the image data and the even part 120 of the image data to a pre-processor 130. The pre-processor 130 rearranges the odd part 110 of the image data and the even part 120 of the image data and then divides the rearranged image data into a left part 140 of the image data and a right part 150 of the image data. The left part 140 of the image data and the right part 150 of the image data are individually delivered to the first timing controller 160 and the second timing controller 170, respectively. Through the first timing controller 160 and the second timing controller 170, the scan driver (not shown in the figure) and data drivers 181, 182, 183, and 184 display the whole image data 190 on the liquid display panel.

Referring to FIG. 2, a general block diagram of a conventional data driver, such as 181, 182, 183, or 184, is illustrated. As shown in FIG. 2, the data driver comprises a shift register 210, a first line buffer 220, a second line buffer 230, and a D/A converter 240. The data driver utilizes a signal EIO1 and a clock signal CLK to input digital image data DATA into the first line buffer 220. The signal EIO1 is synchronized with the conventional horizontal synchronizing signal in the liquid crystal display device. In other words, the shift register 210 shifts the signal EIO1 and utilizes the clock signal CLK to generate a latch clock signal for serially writing the digital image data to the first line buffer 220. After the digital image data has been stored in the first line buffer 220 respectively, the shift register 210 will deliver a signal EIO2 to enable the shift register of the next data driver to store the digital image data in the first line buffer thereof.

When the first line buffers 220 of all data drivers have stored the digital image data, the first timing controller 160 and the second timing controller 170 deliver a signal LOAD to the second line buffers of all data drivers. At this moment, the second line buffer 230 latches the digital image data stored in the first line buffer 220 and delivers the digital image data to the D/A converter 240. The D/A converter 240 utilizes a gamma voltage generator (not shown in the figure) to generate a gamma voltage GV to be used as a reference voltage of the D/A converter 240 so as to convert the digital image data into analog image data.

In the conventional technique, the liquid crystal display device needs two timing controllers (the first timing controller 160 and the second timing controller 170 as shown in FIG. 1) and the pre-processor 130 to drive the liquid crystal display panel. As a result, the connection of the circuitry is too complex which will generally require an increase in the area of a printed circuit board (PCB) for mounting the circuitry thereon and hence an increase in the production cost. However, if the PCB area is not increased, there is a possibility that undesirable effects of electromagnetic interference ("EMI") will occur.

SUMMARY

There is a need to provide a driving circuit and its driving method for driving a liquid crystal display device without using a pre-processor. Such a circuit and its driving method would reduce the complexity of the circuitry and the area of a printed circuit board for mounting the circuitry thereon as well as the production cost.

In an aspect, the present invention provides a driving circuit for driving a liquid crystal display device. The driving circuit comprises a first timing controller for receiving a first part of digital image data; a second timing controller for receiving a second part of the digital image data; and a plurality of data drivers, each of which is electrically connected to both the first timing controller and the second timing controller to receive the first part or the second part of the digital image data through the first timing controller or the second timing controller, respectively, for driving said liquid crystal display device.

In a further aspect, the present invention provides a driving circuit for driving a liquid crystal display device, said driving circuit comprising: a plurality of timing controllers for receiving respective parts of digital image data; and a plurality of data drivers, each of which is electrically connected to all said timing controllers to receive said digital image data through said timing controllers for driving said liquid crystal display device.

In another aspect, the present invention provides a driving method of driving a liquid crystal display device, said method comprising the steps of: receiving a first part of digital image data through a first timing controller; receiving a second part of said digital image data through a second timing controller; and providing said first and said second parts of said digital image data to a plurality of data drivers, each of which is electrically connected to both said first and said second timing controllers, for driving said liquid crystal display device.

Additional aspects and advantages of embodiments of the present invention are set forth in part in the description which follows, and in part are apparent from the description, or may be learned by practice of the disclosed embodiments. The aspects and advantages of the disclosed embodiments may also be realized and attained by the means of the instrumentalities and combinations particularly pointed out in the appended claims.

BRIEF DESCRIPTION OF THE DRAWINGS

The disclosed embodiments are illustrated by way of example, and not by limitation, in the figures of the accompanying drawings, wherein elements having the same reference numeral designations represent like elements throughout.

DETAILED DESCRIPTION OF EMBODIMENTS

Figure 1:
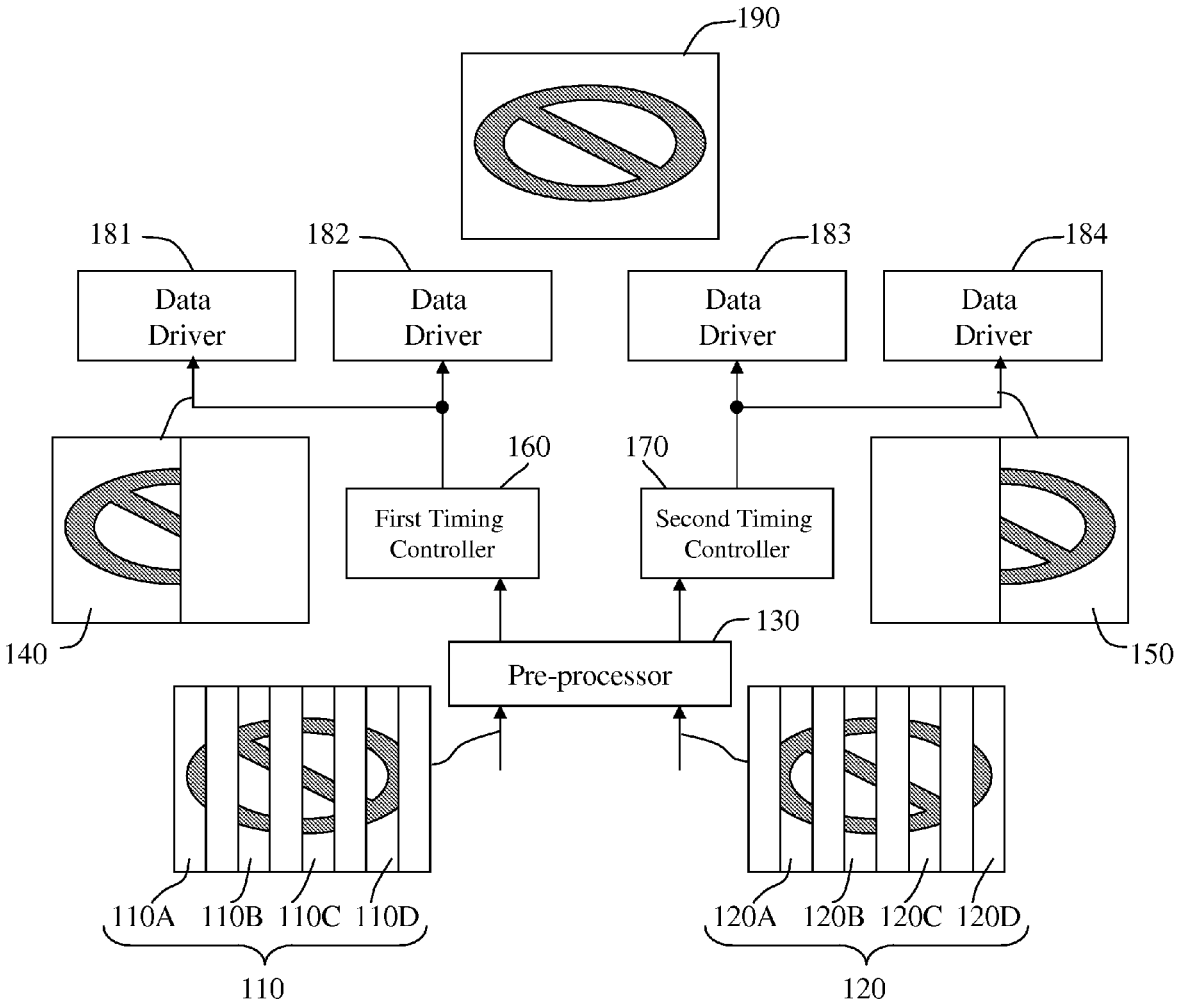
Fig. 1 (PRIOR ART)
FIG. 1 is a general block diagram of a driving circuit in a conventional liquid crystal display device.
Figure 2:
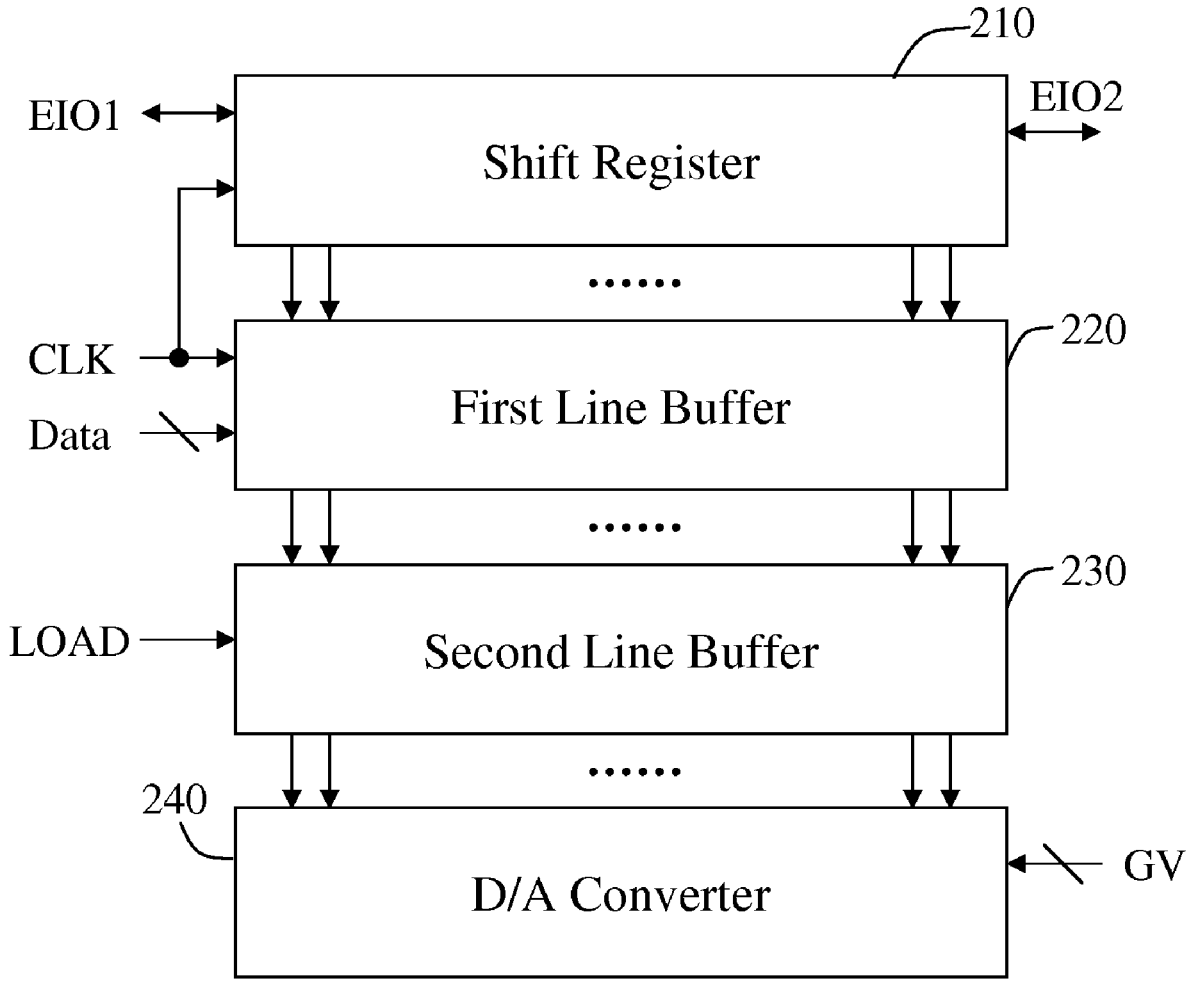
Fig. 2 (PRIOR ART)
FIG. 2 is a general block diagram of a conventional data driver.
Figure 3:
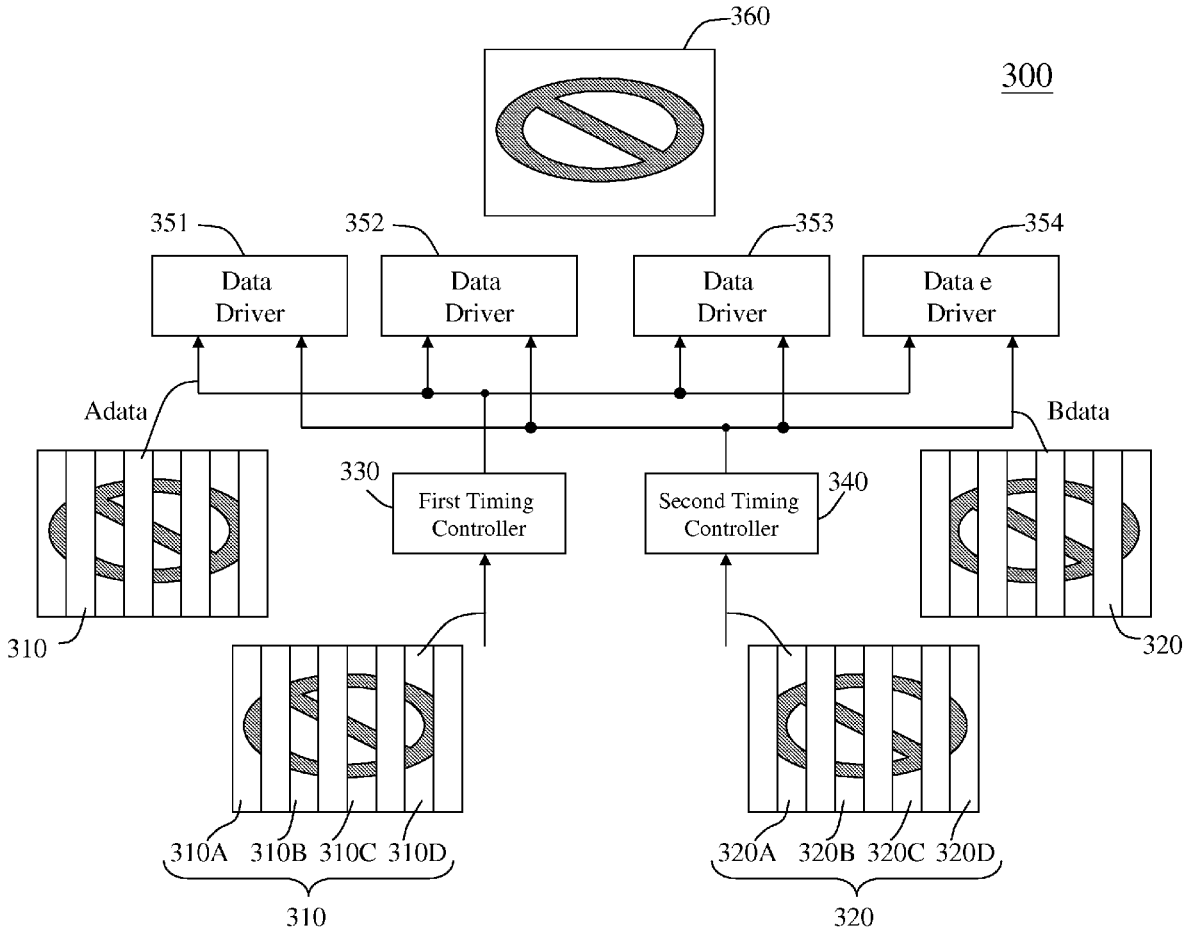
FIG. 3 a general block diagram of a driving circuit for driving a liquid crystal display device according to a first embodiment of the present invention.

Referring to FIG. 3, a general block diagram of a driving circuit for driving a liquid crystal display device according to a first embodiment of the present invention is illustrated. As shown in FIG. 3, the driving circuit 300 comprises a first timing controller 330, a second timing controller 340, and a plurality of data drivers 351, 352, 353, 354 Although in this embodiment four data drivers are used as an example, the present invention is not limited to four data drivers and can use any suitable number of data drivers.

Similar to the conventional image data transmission technique, image data is divided into an odd part 310 and an even part 320, wherein one half of the data bus lines are utilized to transmit the odd part 310 of the image data and the other half of the data bus lines are utilized to transmit the even part 320 of the image data. The odd part 310 of the image data includes several odd sections 310A, 310B, 310C, and 310D of the image data. Each odd section contains a part of the image data which is delivered by at least one data bus line. Additionally, the even part 320 of the image data includes several even sections 320A, 320B, 320C, and 320D of the image data. Each even section also contains a part of the image data which is delivered by at least one data bus line.

However, unlike the conventional image data transmission technique where the odd part and the even part of the image data are commonly input into a pre-processor, the odd part 310 of the image data and the even part 320 of the image data in accordance with the first embodiment are individually delivered to the first timing controller 330 and the second timing controller 340. The first timing controller 330 and the second timing controller 340 are electrically connected via two data buses, e.g., 371, 372, to a plurality of data drivers 351, 352, 353, 354 and a plurality of scan drivers (not shown). Through the first timing controller 330 and the second timing controller 340, the data drivers 351, 352, 353, 354 and the scan drivers can display the whole image data 360 on the liquid display panel. Compared with the first embodiment of the present invention, the conventional data driver only has one input terminal. However, the data drivers 351, 352, 353, 354 in this embodiment of the present invention has two independent input terminals for receiving the digital image data (i) Adata from data bus 371 coupled to the output of the first timing controller 330, and (ii) Bdata from data bus 372 coupled to the output of the second timing controller 340. By eliminating the need for a pre-processor, the first embodiment can reduce the complexity of the circuitry and the area of a printed circuit board for mounting the circuitry thereon as well as costs.

Figure 4:
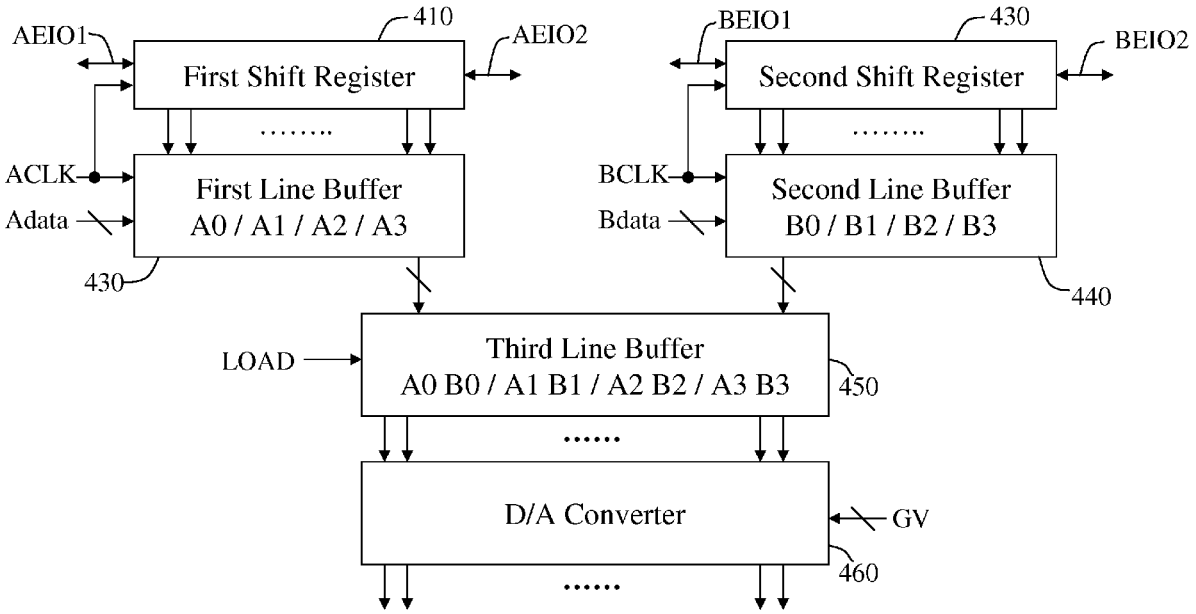
FIG. 4 is a general block diagram of a data driver according to the first embodiment of the present invention.

Referring to FIG. 4, a general block diagram of a data driver, i.e., any of data drivers 351, 352, 353, 354, according to the first embodiment of the present invention is illustrated. As shown in FIG. 4, the data driver comprises a first shift register 410, a second shift register 420, a first line buffer 430, a second line buffer 440, and a D/A converter 460.

Each data driver utilizes a first enable signal AEIO1, a second enable signal BEIO1, a first clock signal ACLK, a second clock signal BCLK to input first digital image data Adata and second digital image data Bdata into the first line buffer 430 and the second line buffer 440 individually. In this embodiment, the first digital image data Adata is the odd part 310 of the digital image data and the second digital image data Bdata is the even part 320 of the digital image data as will be explained in the following example.

The first enable signal AEIO1 and the second enable signal AEIO2 are synchronized with the horizontal synchronizing signal in the liquid crystal display device. In other words, the first shift register 410 shifts the first enable signal AEIO1 and utilizes the first clock signal ACLK to generate a first latch clock signal for serially writing the corresponding odd section of the odd part 310 of the digital image data to the first line buffer 430. For example, the first shift register 410 of the data driver 351 will write the odd section 31 0A, which is received as Adata from data bus 371, as data A0 in the first line buffer 430 of the data driver 351. After the corresponding odd section of the odd part 310 of the digital image data has been stored in the first line buffer 430, the first shift register 410 will deliver a third enable signal AEIO2 to enable the first shift register of the next data driver to store its corresponding odd section of the odd part 310 of the digital image data into the first line buffer thereof. For example, after the odd section 310A has been stored in the first line buffer 430 of the data driver 351, the first shift register 410 of the data driver 351 will deliver a third enable signal AEIO2 to enable the first shift register of the next data driver, i.e., 352, to store the corresponding odd section 310B in the first line buffer 430 of the data driver 352 as data A1, and so on.

Similarly, the second shift register 420 shifts the second enable signal BEIO1 and utilizes the second clock signal BCLK to generate a second latch clock signal for serially writing the corresponding even section of the even part 320 of the digital image data to the second line buffer 440. For example, the second shift register 420 of the data driver 351 will write the even section 320A, which is received as Bdata from data bus 372, as data B0 in the second line buffer 440 of the data driver 351. After the corresponding even section of the even part 320 of the digital image data has been stored in the second line buffer 440, the second shift register 420 will deliver a fourth enable signal BEIO2 to enable the second shift register of the next data driver to store its corresponding even section of the even part 320 of the digital image data into the second line buffer thereof. For example, after the even section 320A has been stored in the second line buffer 440 of the data driver 351, the second shift register 420 of the data driver 351 will deliver a fourth enable signal AEIO2 to enable the second shift register of the next data driver, i.e., 352, to store the corresponding even section 320B in the second line buffer 440 of the data driver 352 as data B1, and so on.

When the first line buffers 430 and the second line buffers 440 of all data drivers have stored the digital image data, the first timing controller 330 or the second timing controller 340 delivers a signal LOAD to the third line buffers 450 of all data drivers.

At this moment, each third line buffer 450 alternatively latches the digital image data, e.g., A0, A1, A2 or A3, stored in the corresponding first line buffer 430 and the digital image data, e.g., B0, B1, B2 or B3, stored in the corresponding second line buffer 440, and then delivers the latched digital image data to the D/A converter 460 individually. A gamma voltage generator (not shown) generates a gamma voltage GV to be used as a reference voltage of the D/A converter 460 which converts the digital image data into analog image data for display by the LCD panel.

Figure 5:
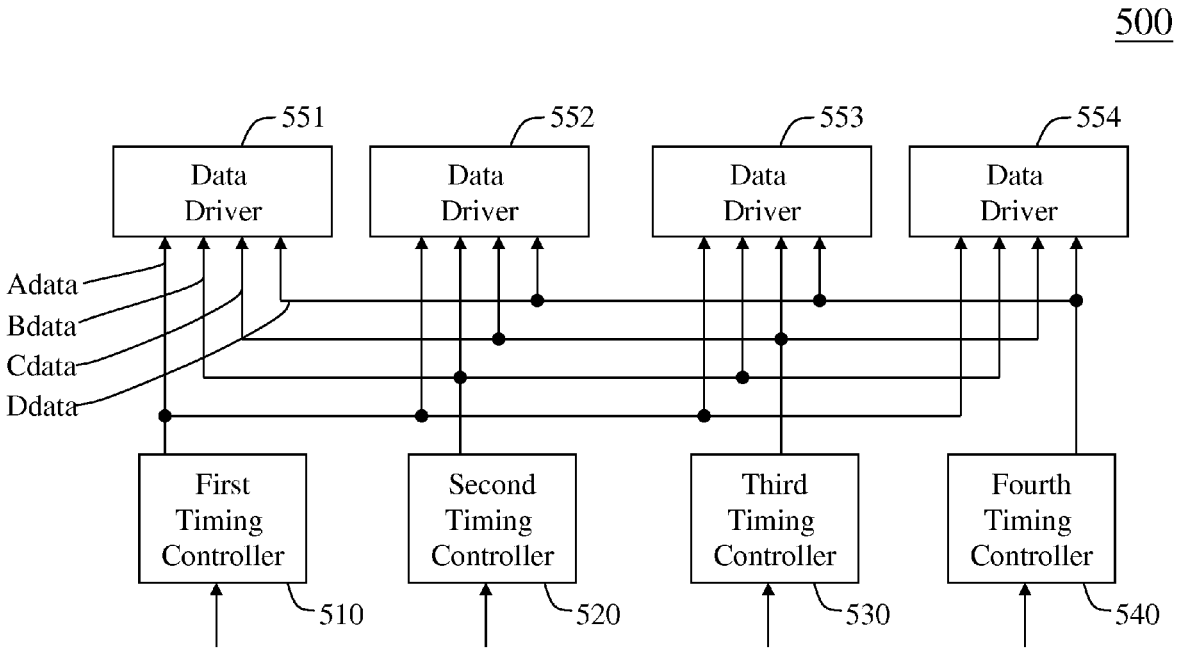
FIG. 5 is a general block diagram of a driving circuit for driving a liquid crystal display device according to a second embodiment of the present invention.

Referring to FIG. 5, a general block diagram of a driving circuit for driving a liquid crystal display device according to a second embodiment of the present invention is illustrated. As shown in FIG. 5, the driving circuit 500 comprises a first timing controller 510, a second timing controller 520, a third timing controller 530, a fourth timing controller 540, and a plurality of data drivers 551, 552, 553, 554. The working principle of the second embodiment is similar to that of the first embodiment. The main differences between the first embodiment and the second embodiment are described as follows. First, the digital image data are divided into four parts which are delivered to the first timing controller 510, the second timing controller 520, the third timing controller 530, and the fourth timing controller 540 individually. Each of the data drivers 551, 552, 553, 554 has four input terminals for receiving four sets of the digital image data Adata, Bdata, Cdata, and Ddata outputted by the first timing controller 510, the second timing controller 520, the third timing controller 530, and the fourth timing controller 540, respectively. The first timing controller 510, the second timing controller 520, the third timing controller 530, and the fourth timing controller 540 are electrically connected via four data buses 571, 572, 573, 574 to the data drivers 551, 552, 553, 554 and a plurality of scan drivers (not shown). Through the first timing controller 510, the second timing controller 520, the third timing controller 530, and the fourth timing controller 540, the data drivers 551, 552, 553, 554 and the scan drivers can display the whole image data on the liquid display panel.

Figure 6:
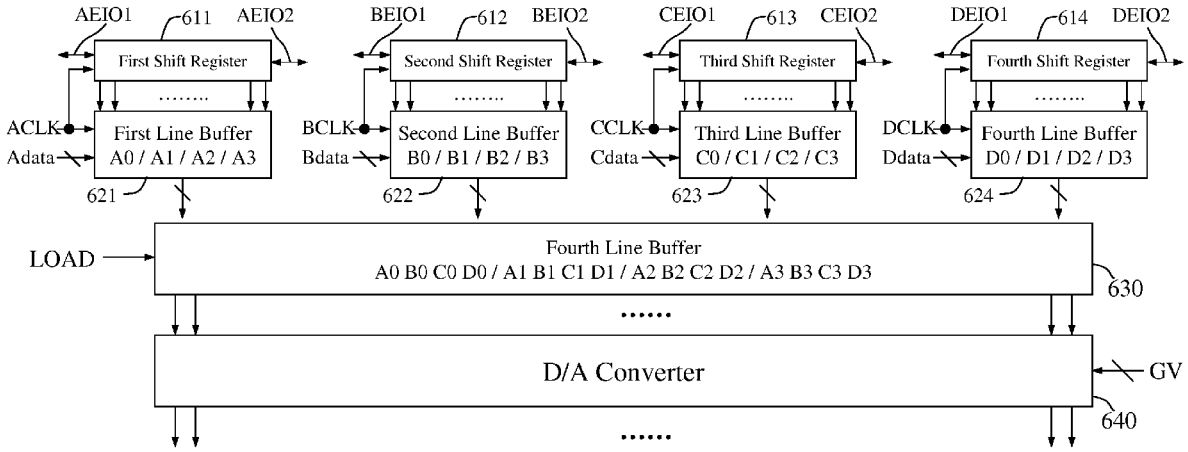
FIG. 6 is a general block diagram of a data driver according to the second embodiment of the present invention.

Referring to FIG. 6, a general block diagram of a data driver, i.e., any of data drivers 551, 552, 553, 554, according to the second embodiment of the present invention is illustrated. As shown in FIG. 6, the data driver comprises a first shift register 611, a second shift register 612, a third shift register 613, a fourth shift register 614, a first line buffer 621, a second line buffer 622, a third line buffer 623, a fourth line buffer 624, a fifth line buffer 630, and a D/A converter 640.

Each data driver utilizes a first enable signal AEIO1, a second enable signal BEIO1, a third enable signal CEIO1, a fourth enable signal DEIO1, a first clock signal ACLK, a second clock signal BCLK, a third clock signal CCLK, and a fourth clock signal DCLK to input digital image data Adata, Bdata, Cdata, and Ddata into the first line buffer 621, the second line buffer 622, the third line buffer 623, and the fourth line buffer 624 individually. The working principle of the data driver according to the second embodiment is similar to that of the data driver according to the first embodiment and will not be repeated herein.

Figure 7:
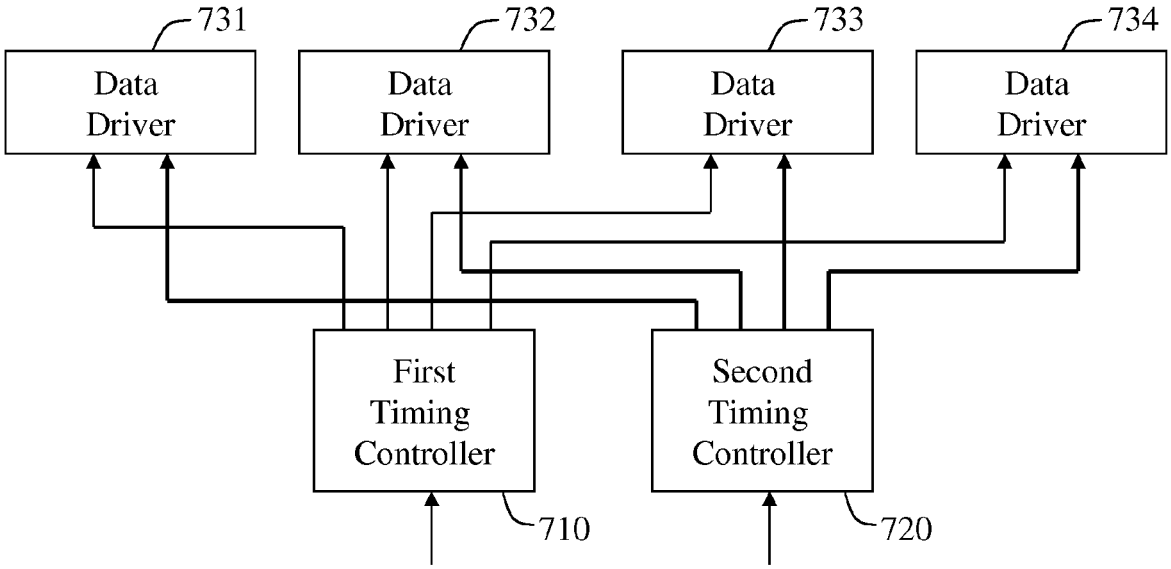
FIG. 7 is a general block diagram of a driving circuit for driving a liquid crystal display device according to a third embodiment of the present invention.

Referring to FIG. 7, a general block diagram of a driving circuit for driving a liquid crystal display device according to a third embodiment of the present invention is illustrated. As shown in FIG. 7, the driving circuit comprises a first timing controller 710, a second timing controller 720, and a plurality of data drivers 731, 732, 733, 734. The main differences between the first embodiment and the third embodiment are described as follows. The first timing controller 710 and the second timing controller 720 utilize point-to-point connections for electrical connection to each of the data drivers 731, 732, 733, 734 individually. In contrast, in the first embodiment, the first timing controller 330 and the second timing controller 340 utilize two data buses for electrical connection to a plurality of data drivers 311, 352, 353, 354 individually. The advantage of the driving circuit according to a third embodiment is that by utilizing point-to-point connections the next image data transmission can start without waiting for the whole transmission of the previous image data. For example, all data drivers 731, 732, 733, 734 in accordance with the third embodiment can simultaneously receive respective data sections from the first timing controller 710, whereas in accordance with the first embodiment, data transmission to the subsequent data driver, e.g., 352 or 732, cannot start until after data transmission for the previous data driver, e.g., 351 or 731, has been completed. In other aspects, the third embodiment is similar to the first embodiment.

To sum up, the disclosed embodiments of the present invention provide a driving circuit and its driving method for driving a liquid crystal display device without using a preprocessor. Additionally, the driving circuit and its driving method can reduce the complexity of the circuitry and the area of a printed circuit board for mounting the circuitry thereon as well as costs.

The foregoing description of the embodiments of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Many modifications and variations will be apparent to practitioners skilled in this art. It is intended that the scope of the invention be defined by the claims appended hereto and their equivalents in which all terms are meant in their broadest reasonable sense unless otherwise indicated. Moreover, no element and component in the present disclosure is intended to be dedicated to the public regardless of whether the element or component is explicitly recited in the following claims.

What is claimed is:

1. A driving circuit for driving a liquid crystal display device, said driving circuit comprising:

a first timing controller for receiving a first part of digital image data;

a second timing controller for receiving a second part of said digital image data; and a plurality of data drivers, each data driver is directly connected to the first timing controller and the second timing controller and configured to receive said first part and said second part of said digital image data through said first timing controller and said second timing controller, respectively, for driving said liquid crystal display device;

wherein each said data driver includes:

a first shift register for receiving a first enable signal and a first clock signal;

a second shift register for receiving a second enable signal and a second clock signal;

a first line buffer for receiving a first digital image data, wherein said first shift register utilizes said first enable signal and said first clock signal to input a corresponding portion of said first part of said digital image data as said first digital image data into said first line buffer:

a second line buffer for receiving a second digital image data, wherein said second shift register utilizes said second enable signal and said second clock signal to input a corresponding portion of said second part of said digital image data as said second digital image data into said second line buffer;

a third line buffer for receiving and combining said first digital image data stored in said first line buffer and said second digital image data stored in said second line buffer; and a D/A converter for receiving said combined first and second digital image data stored in said third line buffer and converting said combined first and second digital image data into analog image data for subsequent use by the liquid crystal display device.

2. The driving circuit as recited in claim 1, wherein each said data driver further comprises two input terminals, and each said input terminal is electrically connected to one of said first timing controller and said second timing controller individually for receiving said first part or said second part of said digital image data, respectively.

3. The driving circuit as recited in claim 1, further comprising two data buses each electrically and individually connecting one of said first timing controller and said second timing controller to all of said data drivers.

4. The driving circuit as recited in claim 1, further comprising point-to-point connections each electrically and individually connecting one of said first timing controller and said second timing controller to one of said data drivers.

5. The driving circuit as recited in claim 1, wherein, when said first line buffer of a previous one of said data drivers has completely stored the respective first digital image data, said first shift register of said previous data driver delivers a third enable signal to said first shift register of the next data driver to enable said next data driver to store its respective first digital image data in said first shift register of said next data driver.

6. The driving circuit as recited in claim 1, wherein, when said first line buffer of each of said data drivers has completely stored the respective first digital image data, said first digital image data stored in said first line buffer is delivered to the respective third line buffer.

7. The driving circuit as recited in claim 1, wherein, when said second line buffer of a previous one of said data drivers has completely stored the respective second digital image data, said second shift register of said previous data driver delivers a fourth enable signal to said second shift register of the next data driver to enable said next data driver to store its respective second digital image data in said second shift register of said next data driver.

8. The driving circuit as recited in claim 1, wherein, when said second line buffer of each of said data drivers has completely stored the respective second digital image data, said second digital image data stored in said second line buffer is delivered to the respective third line buffer.

9. The driving circuit as recited in claim 1, wherein said first part of said digital image data is an odd part of said digital image data and said second part of said digital image data is an even part of said digital image data.

10. A driving method of driving a liquid crystal display device, said method comprising the steps of:

receiving a first part of digital image data through a first timing controller;

receiving a second part of said digital image data through a second timing controller; and providing said first and said second parts of said digital image data to a plurality of data drivers, wherein each data driver is directly connected to both said first and said second timing controllers, for driving said liquid crystal display device;

wherein each said data driver comprises a first shift register, a second shift register, a first line buffer, a second line buffer, a third line buffer, and a D/A converter, said method further comprising:

said first shift register receiving a first enable signal and a first clock signal;

said second shift register receiving a second enable signal and a second clock signal;

said first shift register utilizing said first enable signal and said first clock signal to input a corresponding portion of said first part of said digital image data as first digital image data into said first line buffer;

said second shift register utilizing said second enable signal and said second clock signal to input a corresponding portion of said second part of said digital image data as second digital image data into said second line buffer;

said third line buffer receiving and combining said first digital image data stored in said first line buffer and said second digital image data stored in said second line buffer; and said D/A converter receiving said combined first and second digital image data stored in said third line buffer and converting said combined first and second digital image data into analog image data for subsequent use by the liquid crystal display device.

11. The driving method, as recited in claim 10, further comprising:

after said first line buffer of a previous one of said data drivers has completely stored the respective first digital image data, said first shift register of said previous data driver delivering a third enable signal to said first shift register of the next data driver to enable said next data driver to store its respective first digital image data in said first shift register of said next data driver.

12. The driving method, as recited in claim 10, further comprising:

when said first line buffer of each of said data drivers has completely stored the respective first digital image data, delivering said first digital image data stored in said first line buffer to the respective third line buffer.

13. The driving method, as recited in claim 10, further comprising:

when said second line buffer of a previous one of said data drivers has completely stored the respective second digital image data, said second shift register of said previous data driver delivering a fourth enable signal to said second shift register of the next data driver to enable said next data driver to store its respective second digital image data in said second shift register of said next data driver.

14. The driving method, as recited in claim 10, further comprising:

when said second line buffer of each of said data drivers has completely stored the respective second digital image data, delivering said second digital image data stored in said second line buffer to the respective third line buffer.

* * * * *